United States Patent [19]

Mozingo

[11] 4,351,199

[45] Sep. 28, 1982

[54] COVER PLATE ARRANGEMENT

[75] Inventor: Robert E. Mozingo, Burlington, Iowa

[73] Assignee: J. I. Case Company, Racine, Wis.

[21] Appl. No.: 167,903

[22] Filed: Jul. 14, 1980

[51] Int. Cl.[3] ..... G05G 1/00

[52] U.S. Cl. ..... 74/566; 180/90.6

[58] Field of Search ..... 74/566, 491; 180/90.6; 277/105, 106

[56] References Cited

U.S. PATENT DOCUMENTS

| | | | |
|---|---|---|---|
| 1,728,306 | 9/1929 | Richardson | 180/90.6 |
| 1,955,453 | 4/1934 | Fletcher et al. | 180/90.6 |
| 2,186,277 | 1/1940 | Tetens | 180/90.6 |
| 2,765,184 | 10/1956 | Mackie | 74/566 |
| 3,178,191 | 4/1965 | Dodd et al. | 277/188 R |
| 3,492,889 | 2/1970 | Hauff | 74/491 |

FOREIGN PATENT DOCUMENTS

| | | | |
|---|---|---|---|
| 1580321 | 5/1970 | Fed. Rep. of Germany | 180/90.6 |

*Primary Examiner*—Kenneth Dorner

*Attorney, Agent, or Firm*—Cullen, Sloman, Cantor, Grauer, Scott & Rutherford

[57] ABSTRACT

A cover plate is disclosed for a hydraulic control panel that houses a series of manually operable valves for controlling a plurality of hydraulic cylinders associated with an implement such as a backhoe. The cover plate includes a one-piece plastic base with a plurality of upstanding, spaced apart, integral formations along its longitudinal extent through which a plurality of control handles are inserted and attached to the valves. Each formation on the cover plate is generally box-shaped with open sides and aligned openings in its upper and lower walls to permit the passage of a respective control handle through the cover plate. A closed-cell, rectangular block insert is sandwiched within each cover plate formation with an opening therethrough which is aligned with the upper and lower openings in the formation. The cover plate reduces the assembly time and labor required for connecting the control handles to the respective valves within the control panel and provides for self-centering of the control handles to a neutral position.

1 Claim, 2 Drawing Figures

COVER PLATE ARRANGEMENT

BACKGROUND OF THE INVENTION

The present invention relates to a hydraulic control panel for an implement such as a backhoe, and more particularly, to a cover plate for the control panel which: (a) reduces the assembly time and labor required for connecting the control handles to respective valves within the control panel; (b) provides improved sealing of the control panel from outside contaminants; and (c) provides self-centering of the control handles to a neutral position when released.

For implements such as backhoes, it is conventional to have a number of hydraulic cylinders associated with the boom, dipper stick, and bucket, and a hydraulic control panel for housing a series of manually operable valves which control each of the hydraulic cylinders to distribute fluid pressure to the desired cylinder. A problem associated with typical hydraulic control panels arises in installing the manually operable control handles to the respective valves housed within the control panel.

Prior to the present invention, a conventional way of assembling the control handles to the valves was to first insert the control handles through sealing boots and then through openings in a cover plate for attachment with the respective valves within the control panel. The boots are intended to seal the openings in the cover plate through which the control handles pass. It is difficult to insert the control handles through these conventional boots and further difficulty results in attempting to secure the boots in the cover plate openings after the control handles are secured to the valves. This has caused excessive time and labor to be expended in assembling or disassembling the components initially and for subsequent repairs. Another problem is that the boots are susceptible to becoming disengaged from the cover plate openings thereby breaking the seal and permitting contaminants to enter the control panel.

Thus, there has been a need for an improved cover plate for a hydraulic control panel that permits easy assembly of the control handles to the respective valves and maintains a seal when assembly is completed. The disadvantages of present cover plate constructions have resulted in the cover plate assembly of the present invention which reduces the assembly time and labor, provides improved sealing against contaminants, and provides other advantages as will be more fully described.

SUMMARY OF THE INVENTION

In accordance with the present invention, a cover plate is provided for a hydraulic control panel that houses series of manually operable valves for controlling a plurality of hydraulic cylinders associated with an implement. The cover plate includes a one-piece plastic base with a plurality of upstanding, spaced apart, integral formations along its longitudinal extent through which a plurality of control handles are inserted. Each formation on the cover plate is generally box-shaped with open sides and aligned openings in its upper and lower walls to permit the passage of a respective control handle through the cover plate. A closed-cell, rectangular block insert of rubber is sandwiched within each cover plate formation with an opening therethrough which is aligned with the upper and lower formation openings.

The installation procedure using the cover plate of the present invention is as follows. The control handles are first inserted through the openings in the closed cell rubber block inserts that are sandwiched within the cover plate formations. The cover plate inserts hold the control handles in a parallel relationship such that their lower ends may be easily attached to the valves within the hydraulic control panel. Then, the cover plate is pushed downwardly and secured to the control panel. Thereafter, the operator may manually operate a selected control handle, and the inserts yield to permit movement of the control handle while maintaining a seal to prevent contaminants from entering the control panel. A further feature provided by the cover plate construction is that the rubber inserts provide a self-centering function whereby the control handles are biased to a neutral position when they are released.

Other advantages and meritorious features of the cover plate construction of the present invention will be more fully understood from the following description of the preferred embodiment, the appended claims, and the drawings, a brief description of which follows.

DESCRIPTION OF THE PREFERRED EMBODIMENT

Figure 1:
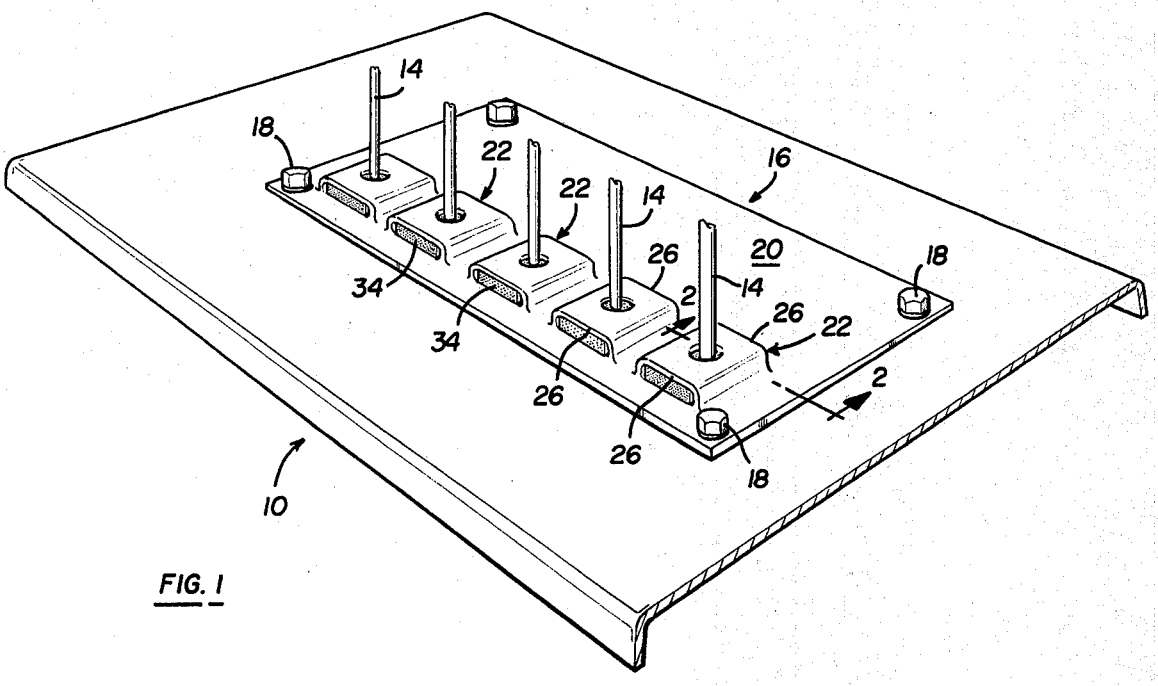
FIG. 1 is a partial perspective view of the cover plate of the present invention mounted on a hydraulic control panel.
Figure 2:
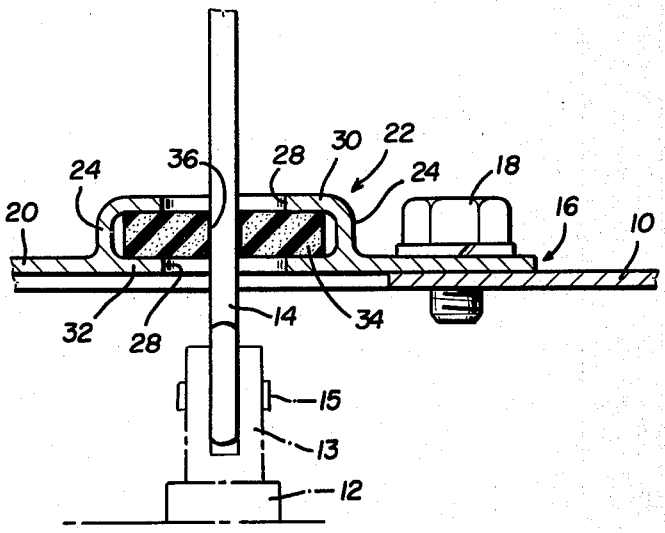
FIG. 2 is a cross-sectional view taken along line 2—2 of FIG. 1.

A preferred embodiment of a hydraulic control panel including the cover plate made in accordance with the teachings of the present invention is illustrated in FIGS. 1–2.

The hydraulic control panel 10 is used for implements such as a backhoe which has a number of hydraulic cylinders (not shown) associated with a boom, dipper stick, and bucket. The control panel 10 houses a series of manually operable valves 12 which control each of the hydraulic cylinders for distributing fluid pressure to the desired cylinder. Each valve includes an upper connecting end 13 which is attached by pin 15 to the lower end of a respective manually operable control handle 14. After assembly, a selected control handle 14 is moved by an operator to control a respective hydraulic cylinder associated with the implement.

The present invention relates to cover plate 16 which is attached to control panel 10 by a series of bolts 18. Cover plate 16 includes a one-piece plastic base 20 with a plurality of upstanding, spaced apart, integral formations 22 along its longitudinal extent through which the control handles 14 are inserted. Each formation 22 is generally box-shaped including opposed ends 24 which are integral with base 20 and ends 26 which are open. Formation 22 further includes aligned openings 28 in its upper wall 30 and lower wall 32 to permit the passage of a control handle 14 through the cover plate. A closed-cell, rectangular block insert 34, made of rubber, is sandwiched within each cover plate formation 22 with an opening 36 therethrough which is aligned with the upper and lower formation openings 28.

The installation of the control handles 14 to valves 12 within control panel 10 using the cover plate 16 of the present invention is as follows. Control handles 14 are first inserted through the openings 36 in the closed-cell block inserts 34 that are sandwiched within cover plate formations 22. The cover plate inserts 34 resiliently hold the control handles in a parallel relationship such that their lower ends may be easily attached to the upper ends 13 of valves 12 within control panel 10. After the control handles 14 are attached to the valves 12, cover plate 16 is pushed downwardly and secured by bolts 18 to control panel 12. Thereafter, the operator pivots a selected control handle 14, and inserts 34 yield to permit movement of the control handle while maintaining a seal to prevent contamination from entering the control panel. Block inserts 34 also provide a self-centering feature where the control handles are biased to a neutral vertical position whenever they are released by the operator.

It will be apparent to those skilled in the art that the foregoing disclosure is examplary in nature rather than limiting, the invention being limited only by the appended claims.

I claim:

1. In a hydraulic control panel that houses a series of manually operable valves which control a plurality of hydraulic cylinders associated with an implement, the improvement comprising:

a one-piece plastic cover plate assembly mounted to said control panel and including a horizontal base with a plurality of upstanding, spaced-apart integral formations along the longitudinal extent of the base through which a plurality of control handles are inserted for attachment to said valves, each cover plate formation being generally box-shaped including upper and lower horizontal walls, opposed ends which are integrally formed with said base and with said upper and lower walls, and other ends which are open, the lower horizontal walls of the formations lying generally in the same plane as the base, the individual formations further including aligned openings in the upper and lower walls to permit the insertion of the control handles through the cover plate, a closed-cell, rectangular rubber block insert sandwiched within each cover plate formation with an opening therethrough which is aligned with the upper and lower openings in an individual formation, said cover plate block inserts permitting movement of said control handles while maintaining a seal to prevent contaminants from entering the control panel and said inserts biasing said control handles towards a vertical neutral position.

* * * * *